United States Patent [19]

Stroucken et al.

[11] Patent Number: 4,643,708

[45] Date of Patent: Feb. 17, 1987

[54] CENTRIFUGE OPERATING SYSTEM

[75] Inventors: Klaus Stroucken; Bengt-Olof Gustafsson, both of Rönninge, Sweden

[73] Assignee: Alfa-Laval Separation AB, Tumba, Sweden

[21] Appl. No.: 769,675

[22] Filed: Aug. 27, 1985

[30] Foreign Application Priority Data

Sep. 6, 1984 [SE] Sweden ..... 8404474

[51] Int. Cl.[4] ..... B04B 3/08

[52] U.S. Cl. ..... 494/40

[58] Field of Search ..... 494/40, 27, 48; 210/781, 782; 422/72

[56] References Cited

U.S. PATENT DOCUMENTS

| | | | |
|---|---|---|---|
| 3,167,509 | 1/1965 | Steinacker | 494/40 |
| 3,189,267 | 6/1965 | Thylefors | 494/40 |
| 3,237,854 | 3/1966 | Thylefors | 494/40 |
| 3,403,849 | 10/1968 | Thylefors | 494/48 |
| 3,550,843 | 12/1970 | Hoffmann | 494/27 |
| 3,749,303 | 7/1973 | Hemfort | 494/40 |

*Primary Examiner*—Robert W. Jenkins

*Attorney, Agent, or Firm*—Cyrus S. Hapgood

[57] ABSTRACT

A centrifugal rotor has (a) an axially movable primary slide (5) for closing or opening peripheral outlets (11) and bordering a closing chamber (14) having inlet (15) and outlet (16) for a closing liquid, and (b) an axially movable secondary slide (20) for allowing or stopping flow through said closing liquid outlet (16), the secondary slide (20) having opposite sides bordering an opening chamber (22) and a closing chamber (21). An axially movable part is located radially outside said closing liquid outlet (16) and forms a partition (12) between the closing chambers (14 and 21) of the primary and secondary slides; the secondary slide's closing chamber (21) is closed radially inwards by an annular seal (24) between the secondary slide (20) and part (12*a*) of said partition (12); and the secondary slide (20) when opening uncovers an annular opening for passage of a closing liquid from the primary slide's closing chamber (14) to the secondary slide's opening chamber (22).

4 Claims, 1 Drawing Figure

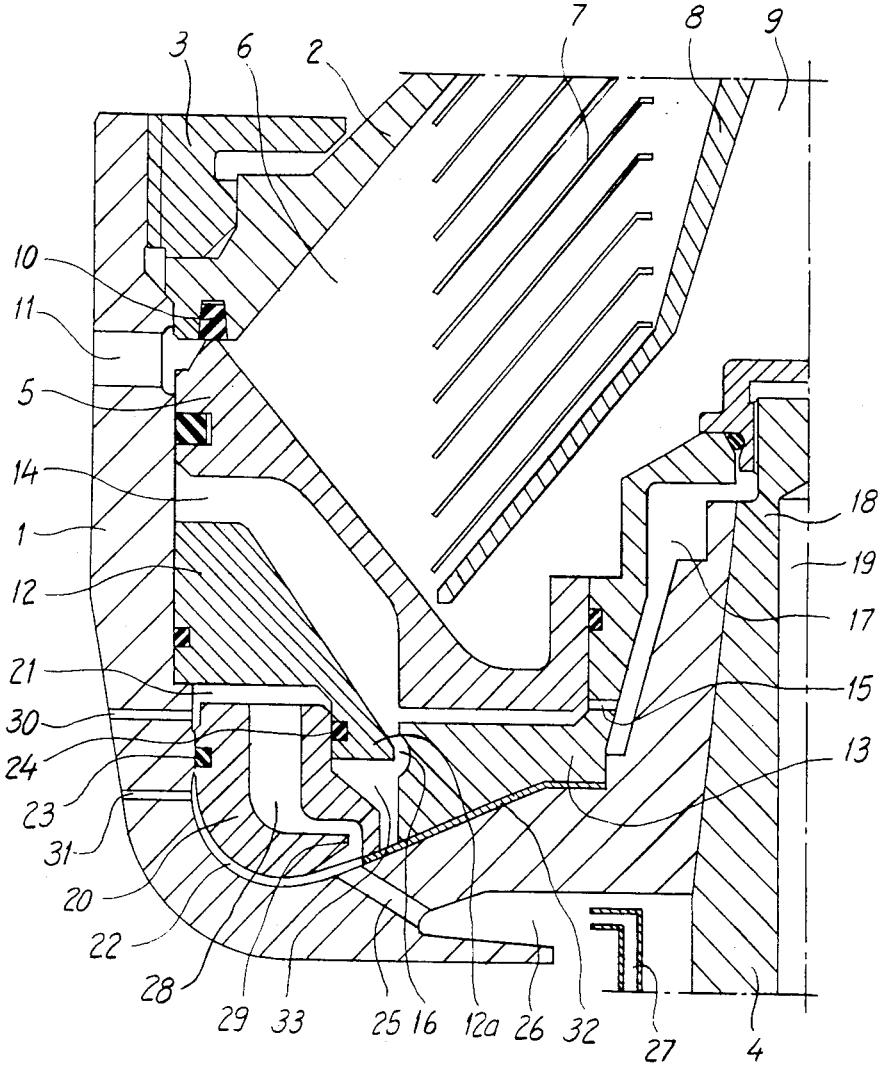
3
6
2
7
8
9
10
11
5
14
1
12
21
30
24
23
31
20
22
28
29
33
25
16
12a
26
32
27
4
18
19
17
15
13

CENTRIFUGE OPERATING SYSTEM

The present invention relates to an operating system for a centrifugal separator of the kind with a rotor comprising (1) an axially movable annular primary slide member, which is arranged to close or open one or more peripheral outlet ports of the rotor separation chamber and which together with axially immovable parts of the rotor forms a closing chamber having inlet and outlet for a closing liquid, (2) an axially movable annular secondary slide member, which is arranged in open position to admit and in closed position to prevent closing liquid from flowing out through said outlet and which together with axially immovable parts of the rotor on one of its axially directed sides defines an opening chamber, having an inlet for an opening liquid and a throttled drainage outlet, and on its other axially directed side defines a closing chamber having a throttled drainage outlet, (3) a means for the supply of closing liquid to the closing chamber of the primary slide member, (4) a means for constant actuation during the operation of the rotor of the secondary slide member with a force in closing direction, and (5) a means for the supply of opening liquid to the opening chamber of the secondary slide member for initiation of an opening movement of the secondary slide member, the opening chamber of the secondary slide member further having an overflow outlet leading to the closing chamber of the secondary slide member and being arranged to receive and being dimensioned to be overfilled by closing liquid leaving the closing chamber of the primary slide member upon an opening movement of the secondary slide member.

An operating system of this kind, described for instance in U.S. Pat. No. 3,550,843, has long been used in practice and has proved superior to many previously proposed operating systems. In the operating system thus known—as in many other operating systems—it is aimed at having as rapid movements as possible of the primary slide member of the rotor. For the obtainment thereof, it is required among other things to have an extremely rapid opening movement of the secondary slide member of the rotor and, therefore, the opening chamber of the secondary slide member is arranged to receive closing liquid from the closing chamber of the primary slide member as soon as the opening movement of the secondary slide member has been initiated by means of a special opening liquid supplied to said opening chamber through a separate liquid inlet. As can be seen from said U.S. Pat. No. 3,550,843, the opening chamber of the secondary slide member there shown will be charged with closing liquid from the closing chamber of the primary slide member through a number of openings distributed around the periphery of the latter as soon as these openings are beginning to be uncovered by the secondary slide member.

The principal object of the present invention is to improve the above noted operating system so that the opening movement of the secondary slide member will be even faster, which will lead to a faster opening movement of the primary slide member, too.

This object is achieved according to the invention by causing an axially immovable part of the rotor, situated radially outside said outlet from the closing chamber of the primary slide member, to form a partition between the closing chamber of the primary slide member and the closing chamber of the secondary slide member, by having the closing chamber of the secondary slide member closed radially inwards by means of an annular sealing member arranged between the secondary slide member and a part of said partition, and by causing the secondary slide member arranged at its axial opening movement to uncover an annular opening for passage of closing liquid from the closing chamber of the primary slide member to the opening chamber of the secondary slide member.

By this design of the centrifuge rotor, it is possible to obtain the largest possible flow of closing liquid out of the closing chamber of the primary slide member at the moment when the opening movement of the secondary slide member is started. This means that the opening chamber of the secondary slide member already at a very early stage is charged with a large amount of liquid evenly distributed around the whole of its circumference. The opening movement of the secondary slide member thereby will be very rapid. This also means that the free liquid surface that is present or will be formed in the closing chamber of the primary slide member, when the opening movement of the secondary slide member is started, moves very rapidly radially outward, which leads to a subsequent rapid opening movement of the primary slide member. When this rapid opening movement of the primary slide member is started, the secondary slide member has already substantially finished its opening movement and, thus, uncovered a maximum annular opening for outflow of closing liquid. Therefore, all the closing liquid having been displaced by the primary slide member from the radially outermost part of the closing chamber of the primary slide member, may leave through the annular opening without influencing the above described rapid movement radially outwards of the free liquid surface in the radially innermost part of the same closing chamber.

In the operating system according to the invention, as in the operating system according to said U.S. patent, the force which is constantly acting on the secondary slide member in its closing direction can be created by means of mechanical springs of one kind or another. However, according to a further development of the invention, this force instead may be created hydraulically by means of liquid supplied to the closing chamber of the primary slide member. This is made possible by arrangement of said annular sealing member for the secondary slide member at a radial distance from the rotor axis which is larger than that of the radially innermost part of the secondary slide member, so that the secondary slide member exposes a surface with a certain radial extension towards a space communicating with the closing chamber of the primary slide member.

In a preferred embodiment, the previously mentioned partition extends with one portion radially inwards past the annular sealing member, so that the last mentioned space is formed axially between this portion and said surface of the secondary slide member. This prevents the magnitude of the force constantly acting on the secondary slide member from decreasing in an undesired degree, when the primary slide member performs its closing movement. This closing movement may cause the liquid surface in the closing chamber of the primary slide member to move radially outward past the level of the radially innermost part of the secondary slide member. Thanks to the described shape of said partition, such a radial movement of the liquid surface in the closing chamber of the primary slide member can be allowed without loss of the liquid and therewith the liquid pressure in said space.

In a particularly advantageous embodiment of the invention, said partition extends with a portion radially inwards past the annular sealing member up to a level radially inside the radially innermost part of the secondary slide member. Further, in this embodiment the opening chamber and the closing chamber of the secondary slide member are large enough to allow an unobstructed outflow of closing liquid though the annular opening which is uncovered in connection with the opening movement of the secondary slide member. By this is achieved not only the already mentioned advantage, that the force constantly acting on the secondary slide member is maintained, but also that the point where the movement of the liquid surface radially outwards within the closing chamber of the primary slide member is interrupted becomes independent of the closing movement of the secondary slide member. This point instead is determined by the position of the radially innermost part of the partition.

The invention will be described more in detail in the following with reference to the accompanying drawing, in which the single illustration is a sectional view of part of the rotor of a centrifugal separator, comprising an operating system according to the invention.

The rotor in the drawing has a rotor body consisting of a bowl-shaped lower part 1 and a conical upper part 2. The rotor body parts 1 and 2 are axially held together by means of a lock ring 3. The rotor body is supported by a vertical drive spindle 4, which is connected with the lower rotor body part 1.

Within the rotor body is an axially movable annular primary slide member 5, which together with the upper rotor body part 2 forms a separating chamber 6. Within the separating chamber is a set of conical separating discs 7, which rest on a so-called distributor 8 arranged to conduct liquid into the separating chamber 6 from an inlet 9.

The primary slide member 5 is arranged to move axially from its position shown in the drawing, in which its periphery portion abuts an annular gasket 10 in a groove in the rotor body part 2, to a position in which it uncovers a number of outlet ports 11 located in the rotor body part 1 and distributed around the rotor periphery. When the ports 11 are uncovered during operation of the rotor, part of the separating chamber content will be thrown out therefrom.

Within the rotor body there are also two annular axially immovable rotor parts 12 and 13. These form together with the primary slide member 5 a so-called closing chamber 14, which has a central liquid inlet in the form of several holes 15 distributed around the rotor axis, and a liquid outlet in the form of an annular slot 16 formed between the rotor parts 12 and 13.

The inlet holes 15 communicate through a chamber 17 and a number of channels 19 with a central channel 19 in the rotor drive spindle 4, through which a so-called closing liquid can be supplied to the rotor during operation by means of equipment not shown but well known in the art.

Within the rotor body there is also an axially movable annular secondary slide member 20. Between the axially upwardly directed side thereof and the rotor part 12 there is formed a further closing chamber 21, and between its axially downwardly directed side and the lower rotor body part 1 there is formed a so-called opening chamber 22. The rotor part 12 thus forms an axially immovable partition between the closing chamber 14 of the primary slide member and the closing chamber 21 of the secondary slide member. The closing chamber 21 as well as the opening chamber 22 are closed radially outwards by means of an annular sealing member 23 arranged between the secondary slide member 20 and the rotor body part 1. Radially inward the closing chamber 21 is closed by means of an annular sealing member 24 arranged between the secondary slide member and the rotor part 12, whereas the opening chamber 22 is open radially inwards and arranged from this direction to receive a flow of so-called opening liquid from an inlet in the form of a number of holes 25 extending through the rotor body part 1 and distributed around the periphery of the rotor. The holes 25 start from an annular groove 26 which is open radially inwards and formed on the outside of the rotor body. A stationary supply pipe 27 is arranged for the supply of opening liquid to the groove 26 during operation of the rotor.

The secondary slide member 20 is provided with a large number of through channels 28 which extend from the radially inner part of the opening chamber 22 to the closing chamber 21. The secondary slide member forms at the edges of the openings of the channels 28 into the opening chamber an overflow outlet 29 from the opening chamber 22, which thus leads to the closing chamber 21. The closing chamber 21, which has a substantially larger volume than the opening chamber 22 (as a consequence of a recess formed in the secondary slide member 20), has a throttled drainage outlet 30. The opening chamber 22 has a similar throttled drainage outlet 31.

The radially innermost part of the secondary slide member 20 is situated radially inside the sealing member 24 and is arranged to seal axially against a plate 32, which is squeezed between the rotor part 13 and the rotor body part 1. The said innermost part of the secondary slide member exposes an annular surface with a certain radial extension towards a space 33 formed axially between said surface and a portion **12*a* of the rotor part 12. The portion 12*a* extends radially inward farther than the secondary slide member 20**.

As can be seen from the drawing, the axial extension of the closing chamber 14 of the primary slide member differs at the regions radially inside and radially outside, respectively, of the outlet 16. The reasons for this are the following. The radially innermost part of the closing chamber 14 should have as small a volume as possible in order to be drained rapidly when the secondary slide member 20 is opened, and then to be rapidly refilled. At least in the area closest to the outlet 16 radially outside thereof, the closing chamber 14 should have a large axial extension so that the displacement of the closing liquid, resulting from the primary slide member movements, shall cause as small a radial movement as possible of the free liquid surface in said area.

The above-described system operates in the following manner. Before the rotor inlet 9 can be opened for a liquid mixture of components to be separated, operating liquid is supplied through the channel 19 of the rotating drive spindle 4. Through the holes 18, chamber 17 and holes 15, the operating liquid enters the closing chamber 14. This operating liquid works as a closing liquid for the primary slide member 5, which is brought to axial sealing against the gasket 10 as soon as a radially outer part of the closing chamber 14 has been filled with liquid.

When the liquid level has reached the outlet 16 of the closing chamber 14, closing liquid flows axially down therethrough and fills the space 33. By the liquid pressure then created on the surface of the secondary slide member 20 exposed to the space 33, the secondary slide member 20 is pressed to axial sealing against the plate 32. Thereafter, the free liquid surface of the closing liquid continues radially inwards, and at the end the whole closing chamber 14 is filled with liquid.

Now the rotor inlet 9 is opened and the separating operation can start. A separated light liquid component of the supplied mixture flows radially inwards through the disc stack 7 to a central outlet (not shown), while a separated heavy component of the mixture, for instance, in the form of a sludge, is collected in the radially outermost part of the separating chamber 6.

After a certain time of operation of the rotor, the peripheral outlets 11 have to be uncovered for discharge of the separated heavy component. To cause this uncovering, operating liquid is supplied for a short period through the supply pipe 27 to the groove 26 at the outside of the rotor body. Through the channels 25 this liquid flows into the opening chamber 22 of the secondary slide member 20, where it serves as an opening liquid.

When the free surface of the opening liquid has reached a certain level in the opening chamber 22, the secondary slide member 20 starts to move axially upward so as to uncover a narrow annular opening between itself and the plate 32. This causes closing liquid to flow out from closing chamber 14 of the primary slide member through the uncovered annular opening, rapidly filling the opening chamber 22. As a consequence of the upward movement of the secondary slide member 20, there will also be a displacement of liquid from the space 33 out through the formed annular opening. A large liquid pressure is thus rapidly built up within the opening chamber 22, which leads to a rapid upward movement of the secondary slide member 20 to its fully opened position.

As soon as the opening chamber 22 is full, further liquid supplied will flow from the closing chamber 14 of the primary slide member through the overflow outlet 29 into the closing chamber 21 of the secondary slide member, where a free liquid surface is formed and starts to move radially inwards.

During the last described course, there is formed a free liquid surface in the radially innermost part of the closing chamber 14 of the primary slide member. This liquid surface moves radially outwards so rapidly that the primary slide member (owing to forces of inertia) does not start its opening movement until the liquid surface has moved a distance towards the outlet 16. The radial extension of the separation chamber 6 and the closing chamber 14 is such, however, that pressures of the same magnitude are exerted on the primary slide member 5 from the liquid mixture in the separation chamber 6 and the closing liquid in the closing chamber 14, already when the free liquid surface in the closing chamber 14 is situated very close to the inlet holes 15.

While the free liquid surface in the closing chamber 14 moves towards the outlet 16, the primary slide member 5 is actuated by a substantially larger force from the mixture in the separation chamber 6 than from the closing liquid in the closing chamber 14, whereby the primary slide member 5 will rapidly perform an opening movement. Already during the last mentioned course—but above all after the liquid surface in the closing chamber 14 has moved out to the outlet 16 and cannot move any more radially outwards—part of the closing liquid is displaced radially inwards from the radially outermost part of the closing chamber 14. This liquid flows through the outlet 16, the annular opening uncovered by the secondary slide member 20, and the channels 28 in the secondary slide member to the closing chamber 21 of the latter.

In the closing chamber 21, a free liquid surface moves radially inwards to a predetermined level. After that—when no further liquid is supplied—the liquid surface in the closing chamber 21 instead moves radially outwards as a consequence of the drainage through the outlet 30. However, the opening chamber 22 is drained through the outlet 31—owing to its small volume—substantially faster than the closing chamber 21, whereby the secondary slide member 20 now returns to its closing position. As can be seen from the drawing, the volume of the closing chamber 21 of the secondary slide member 20 has been increased in the radially inner part of the closing chamber due to the recess in the secondary slide member 20. Further, the opening chamber 22, as has been mentioned above, has a substantially smaller volume than the closing chamber 21, which ensures a rapid closing movement of the secondary slide member 20.

When the primary slide member 5 uncovers the outlet ports 11, the content of the separation chamber 6 is thrown out, and the free liquid surface in the separation chamber moves radially outwards. In a certain position of this liquid surface, pressure balance will prevail across the primary slide member, and upon further movement of the liquid surface the pressure from the closing liquid maintained radially outside the outlet 16 in the closing chamber 14 will return the primary slide member 5 to its closed position.

During all of the above described course, further closing liquid is constantly supplied through the inlet 15. However, this does not prevent the formation and the described movement radially outwards of a liquid surface in the closing chamber 14. As soon as the primary slide member 5 has finished its closing movement, in which stage the secondary slide member 20 is already closed, the closing chamber 14 of the primary slide member is again filled with closing liquid.

We claim:

1. In combination with a centrifugal separator including a rotor having an axis and forming a separating chamber provided with a peripheral outlet port, an axially movable annular primary slide in the rotor for closing and opening said port, said primary slide forming with the rotor a first closing chamber having an inlet and an outlet for a closing liquid, an axially movable annular secondary slide in the rotor having an open position and a closed position for allowing and preventing, respectively, flow of closing liquid through said outlet from said first closing chamber, said secondary slide coacting with the rotor to define on one axially directed side of the secondary slide an opening chamber with an inlet for an opening liquid and a throttled drainage outlet, and to define on the other axially directed side of the secondary slide a second closing chamber with a throttled drainage outlet, means for supplying closing liquid to said first closing chamber, means acting on said secondary slide constantly to urge it toward its closed position during operation of the rotor, and means for supplying opening liquid to said opening chamber for initiating movement of the secondary slide toward its said open position, said opening chamber having an overflow outlet leading to said second closing chamber, said opening chamber being positioned to receive closing liquid leaving said first closing chamber upon movement of the secondary slide to its open position, said opening chamber being dimensioned to hold less than the amount of said closing liquid leaving said first closing chamber, the improvement comprising an axially immovable part of the rotor located radially outside said outlet of the first closing chamber and forming a partition between said first closing chamber and said second closing chamber, and an annular seal arranged between said partition and the secondary slide and acting to seal said second closing chamber radially inward thereof, the secondary slide being operable upon movement toward its open position to uncover an annular opening for passage of closing liquid from said first closing chamber to said opening chamber.

2. The combination of claim 1, in which said annular seal is located at a greater radius from the rotor axis than is the radially innermost part of the secondary slide, said secondary slide having an exposed surface extending radially into a space communicating with said first closing chamber.

3. The combination of claim 2, in which said partition has a portion extending radially inward past said annular seal, whereby said space is formed axially between said portion and said exposed surface of the secondary slide.

4. The combination of claim 1, in which said partition has a part extending radially inward past the annular seal to a level radially inside the radially outermost part of the secondary slide, said opening chamber and said second closing chamber being so dimensioned as to allow an unobstructed discharge of closing liquid from said first closing chamber through said annular opening during the entire opening movement of the primary slide.

* * * * *